US007861952B2

(12) United States Patent
Hsieh

(10) Patent No.: US 7,861,952 B2
(45) Date of Patent: Jan. 4, 2011

(54) SPRINKLER HAVING SHUTOFF CONTROL DEVICE

(76) Inventor: Pai Chou Hsieh, No. 61, Fusin Lane, Homing Village, Hsiushui Hsiang, Changhua Hsien 50444 (TW)

( * ) Notice: Subject to any disclaimer, the term of this patent is extended or adjusted under 35 U.S.C. 154(b) by 287 days.

(21) Appl. No.: 12/151,411

(22) Filed: May 6, 2008

(65) Prior Publication Data

US 2009/0277977 A1 Nov. 12, 2009

(51) Int. Cl.
*A62C 37/20* (2006.01)

(52) U.S. Cl. ..... 239/562; 239/242; 239/550; 239/551

(58) Field of Classification Search ..... 239/220, 239/222, 242, 246, 247, 548, 550, 551, 556, 239/562; 251/299; 222/485, 486, 556
See application file for complete search history.

(56) References Cited

U.S. PATENT DOCUMENTS 3,423,024 A * 1/1969 Morawetz ..... 239/242
5,562,247 A 10/1996 Roman ..... 239/240
5,628,458 A 5/1997 Kuo ..... 239/242
5,645,218 A 7/1997 Heren et al. ..... 239/242
5,657,928 A * 8/1997 Jian ..... 239/242
6,478,241 B1 * 11/2002 Guo ..... 239/562
D470,218 S * 2/2003 Alkalay et al. ..... D23/216
7,258,286 B1 8/2007 Wang et al. ..... 239/562
7,284,714 B1 10/2007 Wang et al. ..... 239/562
7,389,950 B2 * 6/2008 Lo ..... 239/542
7,607,590 B2 * 10/2009 Nies ..... 239/255

* cited by examiner

*Primary Examiner*—Jason J Boeckmann

(57) ABSTRACT

A sprinkler includes a tubular member having a longitudinal track and a number of water discharging openings formed through the track, and one or more shutoff control devices slidably attached onto the track and movable along the track to selectively align with either or some of the water discharging openings of the tubular member and to selectively block and seal the water discharging openings of the tubular member. The shutoff control devices each include a seat slidably attached to the track, and a latch pivotally attached to the seat for selectively blocking either of the water discharging openings of the tubular member and for controlling the water spraying patterns of the sprinkler.

9 Claims, 5 Drawing Sheets

SPRINKLER HAVING SHUTOFF CONTROL DEVICE

BACKGROUND OF THE INVENTION

1. Field of the Invention

The present invention relates to a sprinkler, and more particularly to a sprinkler including a shutoff control device for selectively blocking or sealing one or more of the water spray nozzles and for controlling the water to selectively discharge or flow out through one or more of the water spray nozzles or discharging openings and for controlling the water spraying patterns.

2. Description of the Prior Art

Typical sprinklers comprise one or more tubular members rotatably or pivotally attached and supported in a supporting base and including a number of water discharging holes formed therein for allowing the water to flow out through the water discharging holes.

For example, U.S. Pat. No. 5,562,247 to Roman, and U.S. Pat. No. 5,628,458 to Ko disclose two of the typical oscillating sprinklers each also comprising one or more tubular members including a number of water discharging holes formed therein for allowing the water to flow out through the water discharging holes, and the tubular members may also be rotatably or pivotally attached and supported in a supporting base for swinging or oscillating relative to the supporting base.

However, normally, the water discharging holes may not be selectively blocked or sealed such that the water spraying patterns may not be suitably controlled.

U.S. Pat. No. 5,645,218 to Heren et al. disclose another typical sprinkler having an adjustable water control mechanism attached to the typical sprinkler to control the width of the spray patter discharged from the water discharging openings of the typical sprinkler.

However, similarly, the water discharging openings of the typical sprinkler also may not be selectively blocked or sealed such that the water spraying patterns of the typical sprinkler also may not be suitably controlled.

U.S. Pat. No. 7,258,286 to Wang et al., and U.S. Pat. No. 7,284,714 to Wang et al. disclose two of the typical oscillating sprinklers each comprising a water shutoff and discharge control device for controlling the water to discharge or flow out through the water spray nozzles or discharging openings and for selectively changing the water spraying patterns.

However, a control rod or shaft is required to be attached to the sprinkler and engaged with each of the water spray nozzles or discharging openings in order to control the water to discharge or flow out through each of the water spray nozzles or discharging openings, and the other water spray nozzles or discharging openings that have no control rods or shafts may not be selectively blocked or sealed by the control rods or shafts, or the control rods or shafts may not be used to block or seal the other water spray nozzles or discharging openings.

The present invention has arisen to mitigate and/or obviate the afore-described disadvantages of the conventional water control devices for the sprinklers.

SUMMARY OF THE INVENTION

The primary objective of the present invention is to provide a sprinkler including a shutoff control device for selectively blocking or sealing one or more of the water spray nozzles and for controlling the water to selectively discharge or flow out through one or more of the water spray nozzles or discharging openings and for controlling the water spraying patterns.

In accordance with one aspect of the invention, there is provided a sprinkler comprising a tubular member including a chamber formed therein for receiving a water, and including an inlet formed in a first end portion and communicating with the chamber of the tubular member for receiving the water, and including a second end portion, and including a longitudinal track extended from the tubular member, and including a number of water discharging openings formed in the tubular member and communicating with the chamber of the tubular member and formed through the track, and a shutoff control device slidably attached onto the track and movable along the track to selectively align with either of the water discharging openings of the tubular member and to selectively block and seal the water discharging openings of the tubular member and for controlling the water to selectively discharge or flow out through one or more of the water discharging openings and for controlling the water spraying patterns of the sprinkler.

The shutoff control device includes a seat slidably attached to the track, and a latch pivotally attached to the seat for selectively blocking either of the water discharging openings of the tubular member.

The tubular member includes two channels formed in two opposite side portions of the track for forming two rails on the two opposite side portions of the track, and the seat include a groove formed in the seat for slidably receiving a first rail of the rails of the track and for slidably attaching the seat to the track.

The latch includes a catch for engaging with a second rail of the rails of the track and for openly latching and securing the latch to the seat and the track. The latch includes a hand grip extended opposite to the catch for disengaging the catch from the second rail of the track.

The latch includes a pad disposed therein for sealingly engaging with either of the water discharging openings of the tubular member. The seat include an axle, and the latch includes a cavity formed therein for receiving and engaging with the axle and for pivotally attaching and securing the latch to the seat.

The tubular member includes a number of nozzles engaged into the water discharging openings of the tubular member, and the nozzles each include an aperture formed therein and aligned with the water discharging openings of the tubular member for allowing the water to selectively flow out through the apertures of the nozzles.

A supporting base may further be provided and includes an upper portion for pivotally receiving, and attaching and supporting the rotatable tubular member. The supporting base includes an upper recess formed in the upper portion for pivotally receiving the rotatable tubular member.

The supporting base includes a notch formed in one end portion of the supporting base for pivotally receiving a shaft of the rotatable tubular member. For example, a coupler may be attached or secured to the end portion of the tubular member and the shaft is extended outwardly from the coupler.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
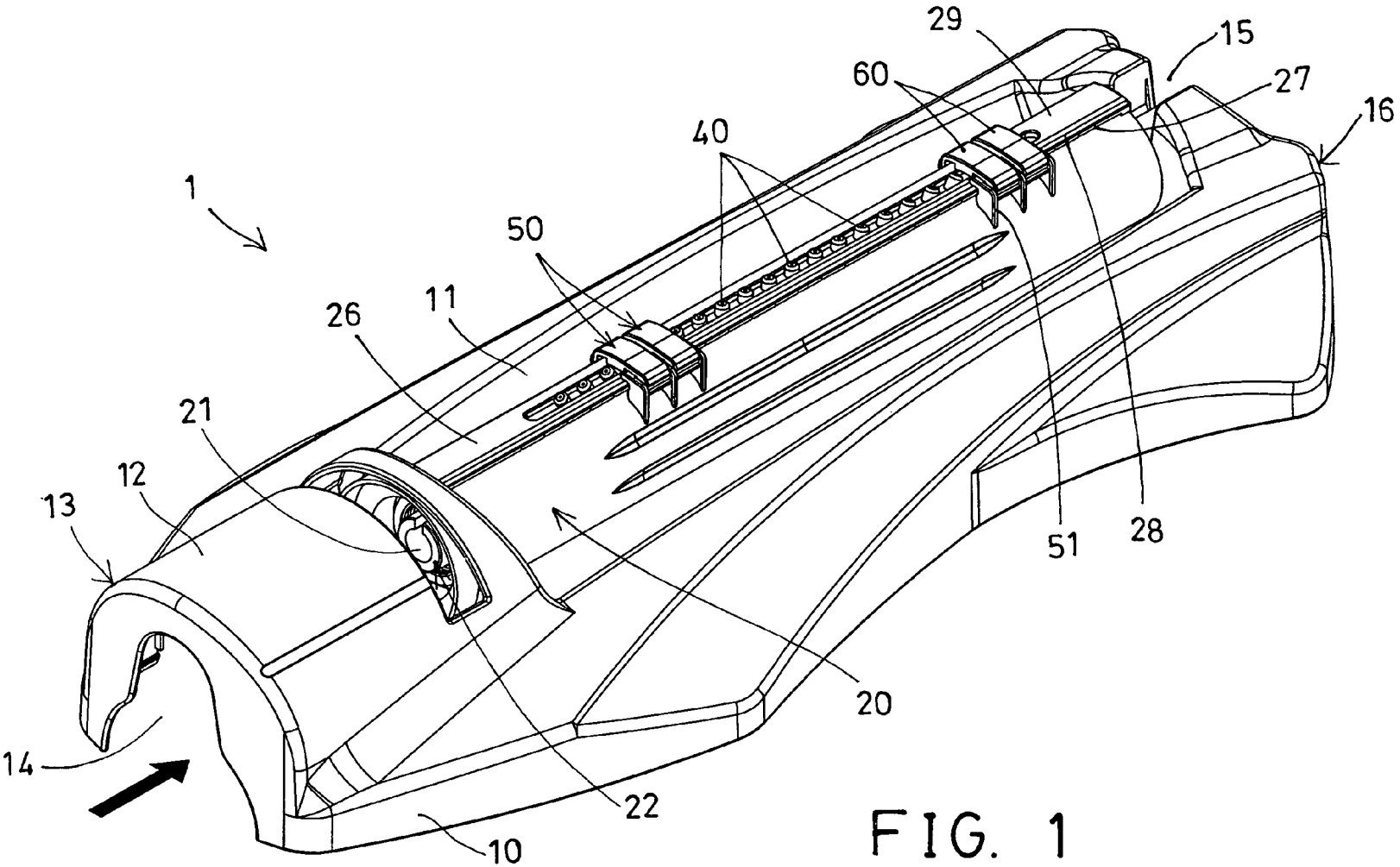
FIG. 1 is a perspective view illustrating a portion of the sprinkler in accordance with the present invention.

Referring to the drawings, and initially to FIG. 1, a sprinkler 1 in accordance with the present invention comprises a supporting base 10 including a concave or recess 11 formed therein, such as formed in the upper portion of the supporting base 10, and including a bulge or housing 12 formed or provided on one end portion 13 of the supporting base 10, and including an entrance 14 formed in the one end portion 13 of the supporting base 10 for coupling to a water reservoir and for receiving the water from the water reservoir, and including a notch 15 formed in the other end portion 16 of the supporting base 10 for rotatably or pivotally attaching and supporting a rotatable tubular member 20.

The rotatable tubular member 20 is rotatably or pivotally attached and supported in the upper portion of the supporting base 10, such as supported in the upper recess 11 of the supporting base 10 and arranged for rotating or swinging or oscillating relative to the supporting base 10, and includes an inlet 21 formed in one end portion 22 of the tubular member 20 (FIGS. 1-3) for coupling to the water reservoir and for allowing the water to flow into the tubular member 20. The tubular member 20 includes a bore or chamber 23 formed therein for receiving the water, and includes a number of water discharging openings 24 formed therein and communicating with the chamber 23 of the tubular member 20 for allowing the water to discharge or flow out through the water discharging openings 24 of the tubular member 20.

A plug or coupler 30 may be attached or secured to the one end portion 22 of the tubular member 20, and includes a port 31 for coupling to the water reservoir and for allowing the water to flow into the tubular member 20, and another plug or coupler 33 may be attached or secured to the other end portion 25 of the tubular member 20, and includes a shaft 34 extended outwardly from the coupler 33 for rotatably or pivotally attaching or engaging with the notch 15 of the supporting base 10 and for allowing the tubular member 20 to be rotatably or pivotally supported in the upper recess 11 of the supporting base 10. A rotating or driving mechanism or device (not shown) may be provided for swinging or oscillating the tubular member 20 relative to the supporting base 10. The above-described structure is typical and will not be described in further details.

As shown in FIGS. 1-5, the tubular member 20 includes a longitudinal beam or track 26 extended upwardly therefrom, and the water discharging openings 24 of the tubular member 20 are aligned with and formed through the track 26, and a number of mouths or nozzles 40 are engaged into the water discharging openings 24 of the tubular member 20 respectively and each include an aperture 41 formed therein and aligned with the water discharging openings 24 of the tubular member 20 for allowing the water to discharge or flow out through the apertures 41 of the nozzles 40. The tubular member 20 further includes two channels 27 formed in the two side portions of the track 26 for forming two rails 28, 29 on the two opposite side portions of the track 26.

The sprinkler 1 in accordance with the present invention further includes one or more shutoff control devices 50 slidably attached onto the track 26 and movable along the track 26 or the channels 27 or the rails 28, 29 for selectively blocking or sealing one or more of the water discharging openings 24 of the tubular member 20 and/or the apertures 41 of the nozzles 40 and thus for controlling the water to selectively discharge or flow out through one or more of the water discharging openings 24 of the tubular member 20 and/or the apertures 41 of the nozzles 40, and for controlling the water spraying patterns of the tubular member 20 of the sprinkler 1.

Figure 4:
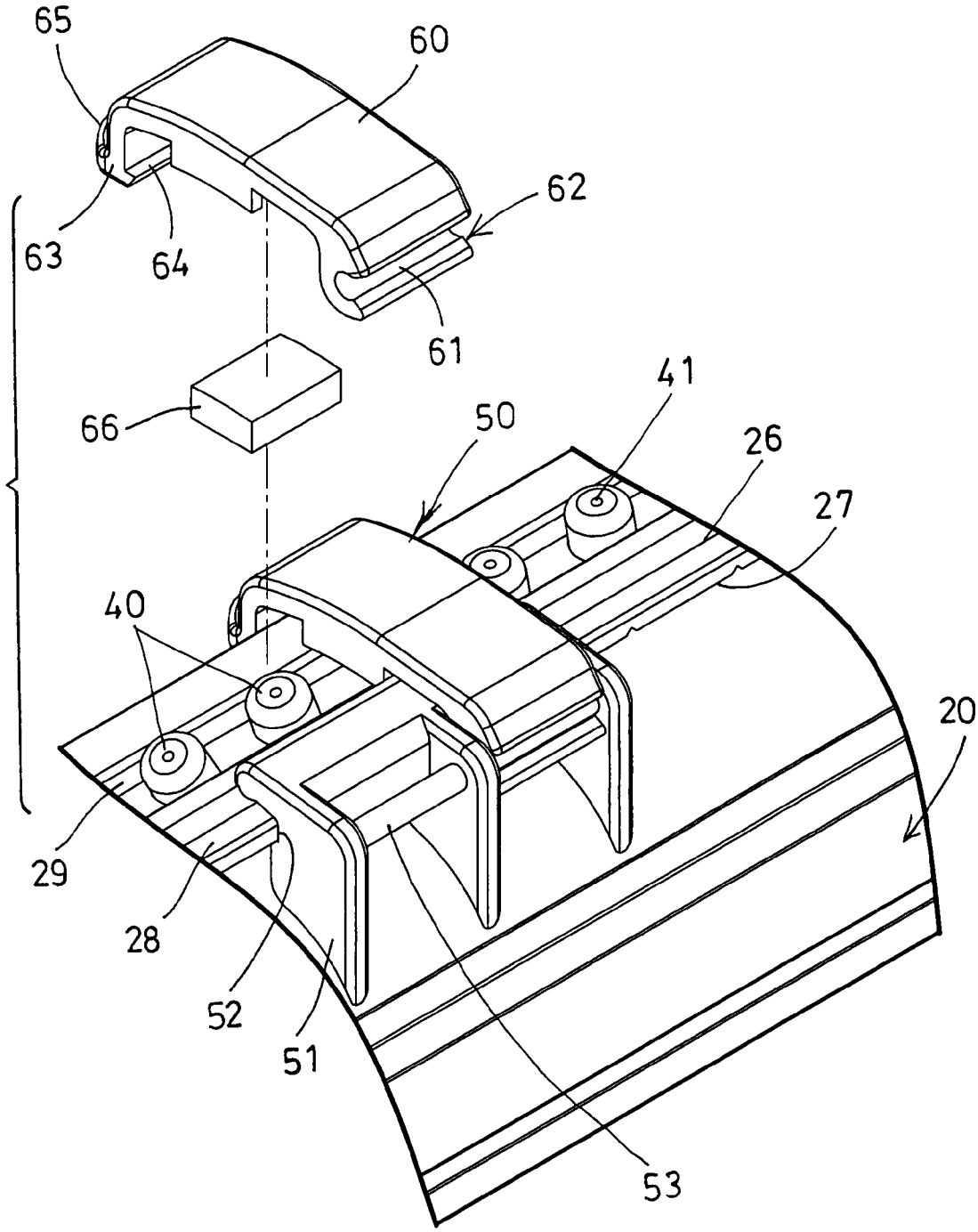
FIG. 4 is a partial exploded view of the rotatable tubular member of the sprinkler including a shutoff control device for controlling the water.
Figure 5:
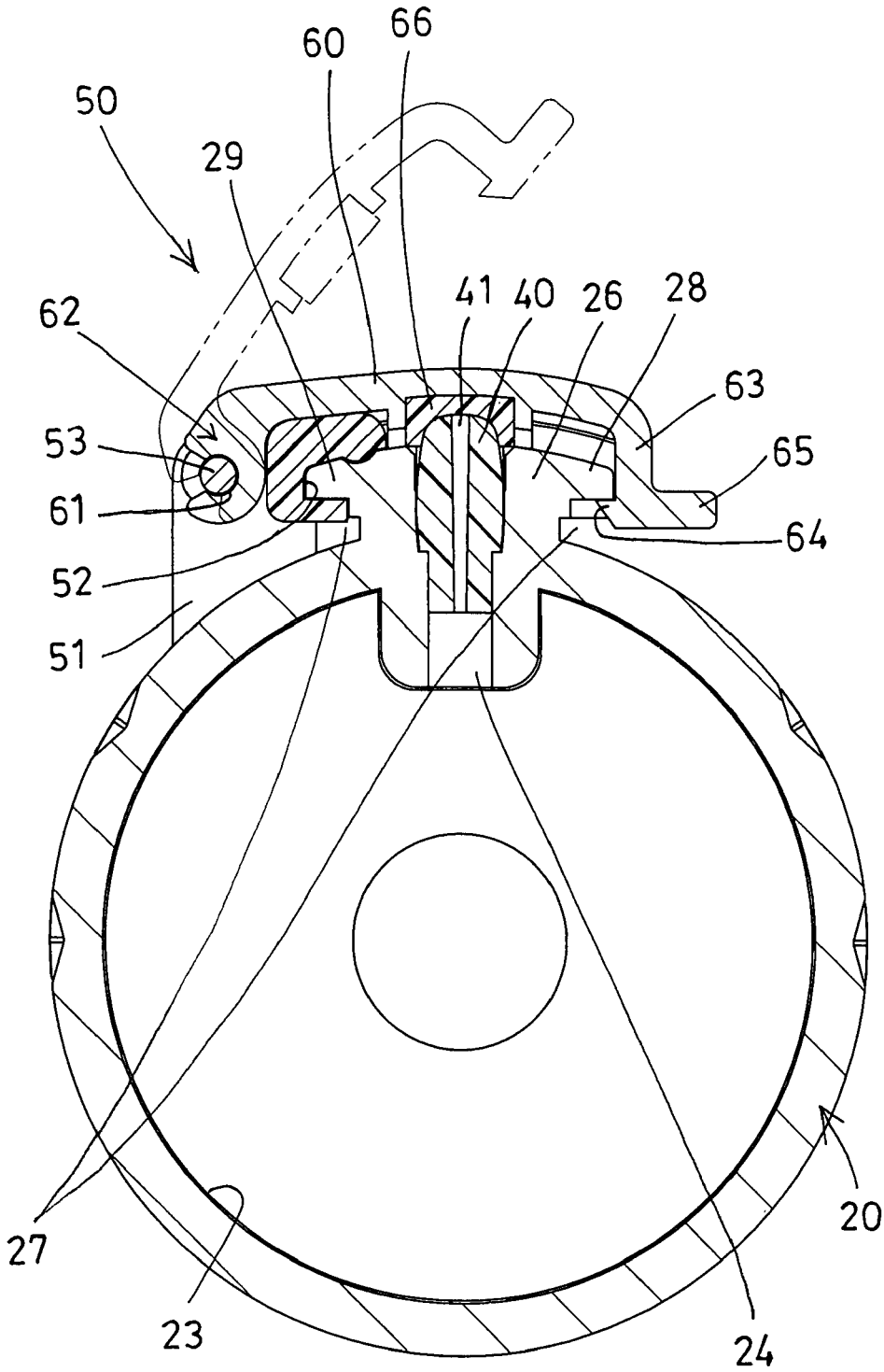
FIG. 5 is a cross sectional view of the rotatable tubular member of the sprinkler, taken along lines 5-5 of FIG. 2, illustrating the operation of the shutoff control device for the sprinkler.

As shown in FIGS. 4 and 5, the shutoff control devices 50 each include a seat 51 having a groove 52 formed therein for slidably receiving one of the rails 28 of the track 26 and for slidably attaching or securing the seats 51 to the track 26 and for allowing the shutoff control devices 50 to be selectively aligned with either or some of the water discharging openings 24 of the tubular member 20. The seats 51 of the shutoff control devices 50 each include an axle 53 disposed or provided therein for rotatably or pivotally attaching or engaging with a latch 60 which includes an opened cavity 61 formed or provided in one end portion 62 thereof for receiving or engaging with the axle 53 and for rotatably or pivotally attaching or securing the latch 60 to the seat 51.

The latch 60 includes another end portion 63 having a tongue or catch 64 extended inwardly therefrom or extended toward the one end portion 62 of the latch 60 for engaging with the other rail 29 of the track 26 and for openly latching or anchoring or securing the latch 60 to the seat 51 and to the track 26 and thus for selectively blocking or sealing one or more of the water discharging openings 24 of the tubular member 20 and/or the apertures 41 of the nozzles 40. The latch 60 includes a knob or handle or hand grip 65 extended from the other end portion 63 thereof and opposite to the catch 64 for disengaging the catch 64 from the other rail 29 of the track 26 and for removing or disengaging the latch 60 form the water discharging openings 24 of the tubular member 20 and/or the apertures 41 of the nozzles 40. It is preferable that the latch 60 includes a soft or resilient gasket or sponge or pad 66 disposed therein for softly and sealingly engaging with the water discharging openings 24 of the tubular member 20 and/or the apertures 41 of the nozzles 40.

Figure 2:
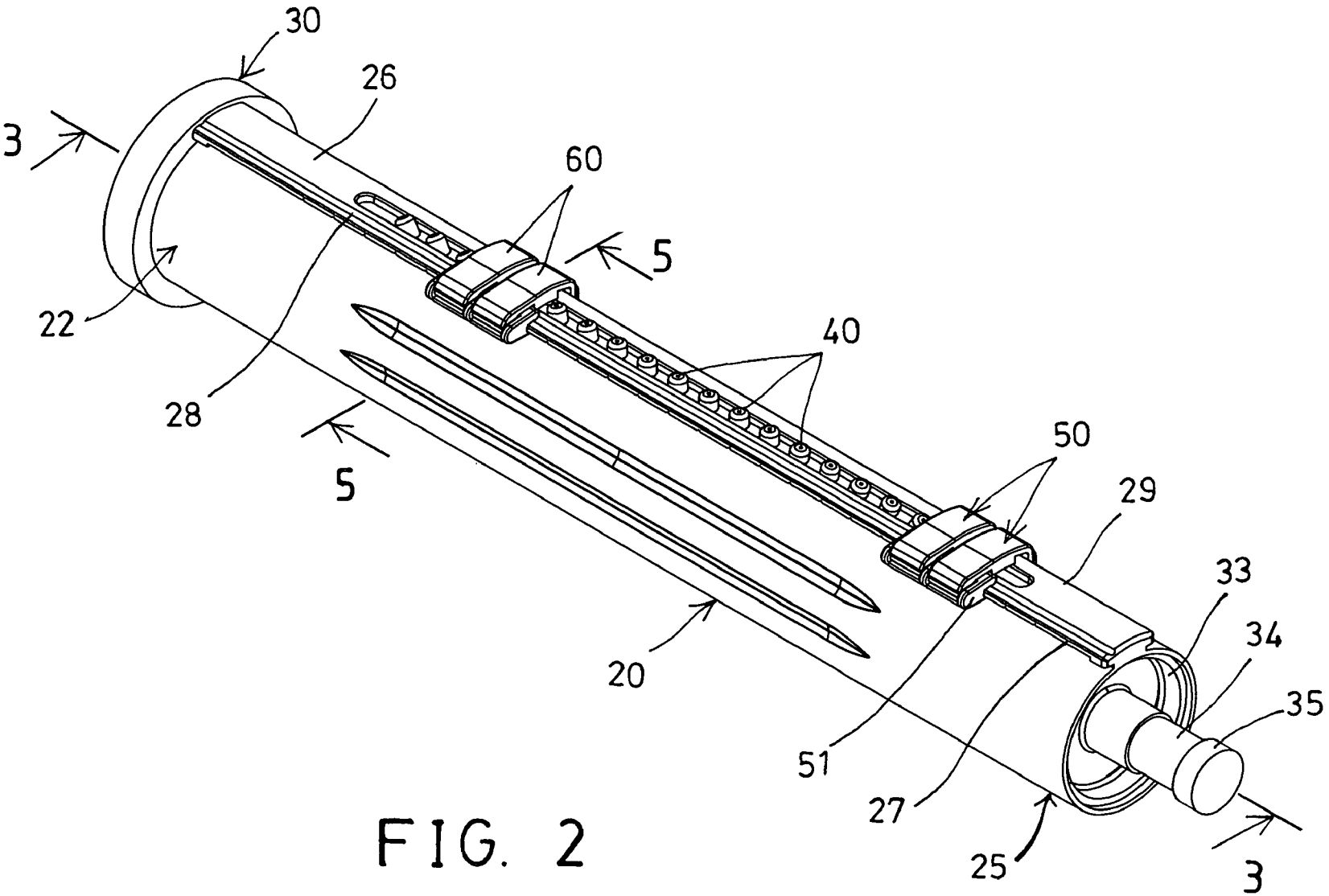
FIG. 2 is a perspective view illustrating a rotatable tubular member of the sprinkler.
Figure 3:
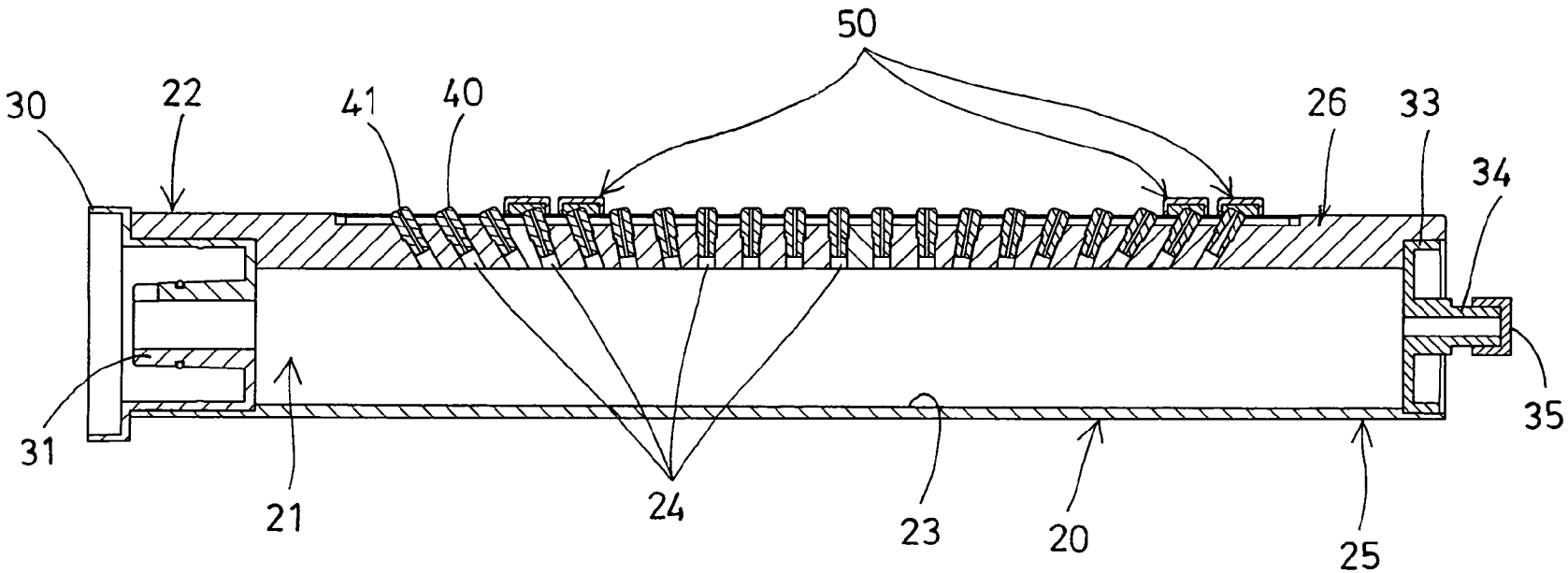
FIG. 3 is a cross sectional view of the rotatable tubular member of the sprinkler, taken along lines 3-3 of FIG. 2.

In operation, as shown in FIGS. 1-3, the seats 51 and the latches 60 of the shutoff control devices 50 may be slidably attached onto the track 26 and may be moved along the track 26 or the channels 27 or the rails 28, 29 to selectively align with either or some of the water discharging openings 24 of the tubular member 20 and/or the apertures 41 of the nozzles 40, and the catches 64 of the latches 60 may then be caused to engage with the other rail 29 of the track 26 (FIGS. 4, 5) for latching the latch 60 to the seat 51 and to the track 26 and for selectively blocking or sealing one or more of the water discharging openings 24 of the tubular member 20 and/or the apertures 41 of the nozzles 40.

It is to be noted that the seats 51 and the latches 60 of the shutoff control devices 50 may be slid or moved along the track 26 or the channels 27 or the rails 28, 29 to align with either or some of the water discharging openings 24 of the tubular member 20 and/or the apertures 41 of the nozzles 40, such that the shutoff control devices 50 may be used to freely engage with or to block or to seal only the required water discharging openings 24 of the tubular member 20 and/or the apertures 41 of the nozzles 40, and it is not required to provide a shutoff control device 50 for each of the water discharging openings 24 of the tubular member 20 and/or the apertures 41 of the nozzles 40. It is further to be noted that the seats 51 of two or more of the shutoff control devices 50 may be secured together (FIG. 4) and moved in concert with each other for moving along the track 26.

Accordingly, the sprinkler in accordance with the present invention includes a shutoff control device for selectively blocking or sealing one or more of the water spray nozzles and for controlling the water to selectively discharge or flow out through one or more of the water spray nozzles or discharging openings and for controlling the water spraying patterns.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprinkler comprising:

a tubular member including a chamber formed therein for receiving a water, and including an inlet formed in a first end portion and communicating with said chamber of said tubular member for receiving the water, and including a second end portion, and including a longitudinal track extended from said tubular member, and including a plurality of water discharging openings formed in said tubular member and communicating with said chamber of said tubular member and formed through said track, said tubular member including two channels formed in two opposite side portions of said track for forming two rails on said two opposite side portions of said track, and a shutoff control device slidably attached onto said track and movable along said track to selectively align with either of said water discharging openings of said tubular member and to selectively block and seal said water discharging openings of said tubular member, said shutoff control device including a seat slidably attached to said track, and a latch pivotally attached to said seat for selectively blocking either of said water discharging openings of said tubular member, said seat including a groove formed therein for slidably receiving a first rail of said rails of said track and for slidably attaching said seat to said track.

2. The sprinkler as claimed in claim 1, wherein said latch includes a catch for engaging with a second rail of said rails of said track and for openly latching and securing said latch to said seat and said track.

3. The sprinkler as claimed in claim 2, wherein said latch includes a hand grip extended opposite to said catch for disengaging said catch from said second rail of said track.

4. The sprinkler as claimed in claim 1, wherein said latch includes a pad disposed therein for sealingly engaging with either of said water discharging openings of said tubular member.

5. The sprinkler as claimed in claim 1, wherein said seat includes an axle, and said latch includes a cavity formed therein for receiving and engaging with said axle and for pivotally attaching and securing said latch to said seat.

6. The sprinkler as claimed in claim 1, wherein said tubular member includes a plurality of nozzles engaged into said water discharging openings of said tubular member, and said nozzles each includes an aperture formed therein and aligned with said water discharging openings of said tubular member.

7. The sprinkler as claimed in claim 1 further comprising a supporting base including an upper portion for pivotally attaching and supporting said rotatable tubular member.

8. The sprinkler as claimed in claim 7, wherein said supporting base includes an upper recess for pivotally receiving said rotatable tubular member.

9. The sprinkler as claimed in claim 7, wherein said supporting base includes a notch formed in one end portion of said supporting base for pivotally receiving a shaft of said rotatable tubular member.

* * * * *